US006739716B2

(12) United States Patent
Richards

(10) Patent No.: US 6,739,716 B2
(45) Date of Patent: May 25, 2004

(54) SYSTEMS AND METHODS FOR CURING A FLUID

(75) Inventor: David B. Richards, Fremont, CA (US)

(73) Assignee: Océ Display Graphics Systems, Inc., San Jose, CA (US)

( * ) Notice: Subject to any disclaimer, the term of this patent is extended or adjusted under 35 U.S.C. 154(b) by 0 days.

(21) Appl. No.: 10/166,284

(22) Filed: Jun. 10, 2002

(65) Prior Publication Data

US 2003/0227527 A1 Dec. 11, 2003

(51) Int. Cl.[7] ..... B41J 2/01
(52) U.S. Cl. ..... 347/102
(58) Field of Search ..... 347/102, 156; 399/320, 336

(56) References Cited

U.S. PATENT DOCUMENTS

| | | | | |
|---|---|---|---|---|
| 3,733,709 | A | | 5/1973 | Bassemir et al. |
| 3,950,650 | A | | 4/1976 | Pray et al. |
| 4,015,340 | A | | 4/1977 | Treleven |
| 4,019,062 | A | | 4/1977 | Rongren |
| 4,297,583 | A | | 10/1981 | Nerod |
| 4,410,560 | A | | 10/1983 | Kosterka |
| 4,798,960 | A | | 1/1989 | Keller et al. |
| 4,839,522 | A | | 6/1989 | Bourgeois et al. |
| 5,003,185 | A | | 3/1991 | Burgio, Jr. |
| 5,117,562 | A | | 6/1992 | Dulay et al. |
| 5,239,613 | A | | 8/1993 | Motev et al. |
| 4,025,795 | A | | 5/1997 | Lackore et al. |
| 5,828,071 | A | | 10/1998 | Bourghelle et al. |
| 5,932,886 | A | | 8/1999 | Arai et al. |
| 5,945,680 | A | | 8/1999 | Jensen |
| 6,135,654 | A | | 10/2000 | Jennel |
| 6,145,979 | A | * | 11/2000 | Caiger et al. ..... 347/102 |
| 6,152,030 | A | | 11/2000 | Fuqua |
| 6,166,366 | A | | 12/2000 | Lewis et al. |
| 6,454,405 | B1 | * | 9/2002 | Stowe ..... 347/102 |
| 6,457,823 | B1 | * | 10/2002 | Cleary et al. ..... 347/102 |

* cited by examiner

*Primary Examiner*—Juanita Stephens
(74) *Attorney, Agent, or Firm*—Workman Nydegger

(57) ABSTRACT

Systems and methods for curing inks with radiation. An apparatus includes a housing that includes a pair of reflectors and/or two separate lamps of different power that direct ultraviolet radiation onto the inks being cured. The pre-cure reflector only reflects a portion of the radiation such that the inks are not fully cured. The pre-cure reflector causes the inks to change or thicken slightly such that they do not move on the media or merge with other inks while still retaining a liquid or wet nature. All colors of ink can then be placed in a single layer before the cure reflector fully cures the UV inks by reflecting sufficient UV radiation onto the single layer of UV ink.

23 Claims, 8 Drawing Sheets

SYSTEMS AND METHODS FOR CURING A FLUID

BACKGROUND OF THE INVENTION

1. The Field of the Invention

The present invention relates to systems and methods for curing fluids. More particularly, the present invention relates to systems and methods for pre-curing ink before the ink is fully cured.

2. Background and Relevant Art

Many different substances, such as inks, lacquers, and glues, are cured using radiation such as ultraviolet (UV) light. These substances typically contain photo initiators that are activated upon exposure to UV light. When the photo initiators within a substance are activated, the substance cures or hardens. UV cured inks are used in a variety of different printing and non-printing applications. One of the advantages of using UV cured inks is that they are less expensive than other types of ink in part because less energy is required to cure UV inks. Also, inks that are cured using UV light are more "environmentally friendly" because they do not contain solvents.

In many printing systems, however, more than one color of ink is used to create an image, with the ink typically placed on a media one color or layer at a time. Because wet ink has a propensity to run on the media and because ink droplets tend to merge together, each layer of ink is usually cured immediately after it is placed or printed on the media. In other words, the first layer or color of ink is therefore cured before the second layer or color of ink is placed on the media. When there are, for example, four different colors of UV ink, there are effectively four layers of cured ink.

FIG. 1A is used to discuss some of the problems that arise when each layer or color of ink is cured separately and illustrates an example of UV inks that are printed in layers. In this example, the different colors of UV ink are printed or placed on a media 100 by different print heads. Each print head is printing a different color of ink on a different portion of media 100. Thus, strips or rows of different colored ink are placed at the same time by the print heads of the printing system, with each row of ink usually cured at the same time. More particularly, the UV inks 114, 116, 118, and 120 are placed at the same time even though inks 114, 116, 118, and 120 correspond to different colors.

As previously stated, ink 114 is placed at the same time as inks 116, 118, and 120. However, ink 114 is in layer 102, ink 116 is in a layer 103, ink 118 is in a layer 104, and ink 120 is in a layer 105. The inks 116, 118, and 120 are printed on other rows or layers of ink that have already been cured. Thus, ink layer 105 is effectively printed on ink layer 104, ink layer 104 is effectively printed on ink layer 103, and ink layer 103 is printed on the layer 102.

While printing one layer of ink on another layer of ink is commonly practiced, the problem of printing UV cured ink on top of another ink layer is becoming evident. Those ink layers deposited last obscure all other ink layer deposited upon the media. Further, because each layer of ink is cured before another layer is deposited thereupon, the layers of ink do not have an opportunity to blend appropriately. These consequences combine to reduce the overall quality of the image being printed. As shown by blocks 112, 110, 108, and 106, the problem becomes more pronounced as additional layers of ink are placed on media 100.

Waiting until all of the ink layers are placed on the media before curing the ink may also lead to unsatisfactory results.

In this instance, the inks retain their liquid nature and are prone to losing their place on the media where they were originally placed. This can occur when two droplets of ink are attracted to each other and merge to form a single larger droplet of ink. Wet inks may also run on the media and thus lessen the quality of the image. In these cases, the print quality is again reduced because the inks do not maintain their original placement on the media.

BRIEF SUMMARY OF THE INVENTION

These and other limitations are overcome by the present invention which relates to systems and methods for curing ink by pre-curing the ink first. When UV ink is exposed to UV radiation, the photo initiators in the ink are activated and the UV ink cures or hardens. The UV radiation is often directed to the UV ink using an illuminator that includes a reflector that reflects UV light from a UV source to the UV inks. As the illuminator moves over the printed UV inks, the photo initiators are activated and the UV inks are cured.

In one embodiment of the present invention, the illuminator includes a pair of reflectors: a pre-cure reflector and a cure reflector. The pre-cure reflector is positioned differently within the illuminator than the cure reflector. A pre-cure reflector does not reflect sufficient radiation to fully cure the UV inks. Instead, the pre-cure reflector reflects enough UV light to change the viscosity of the UV inks such that the UV inks do not run on the media. The pre-cure reflector thus cures the ink enough to prevent the ink from running or merging with other ink, but does not prevent the ink from being fully cured at a later time. The pre-cure reflector also ensures that one color of ink is not cured on top of another color of ink. By pre-curing the inks, all of the inks can be placed on the media and create a more uniform surface, whereas curing each layer or color of ink independently often results in a stack of ink layers without a slight blending and more uniform surface. After all of the different colors of inks have been printed on the media and pre-cured, then the cure reflector fully activates the photo initiators and cures the UV inks in a single layer or film of ink.

In another example, part of the illuminator is blocked. The effect of blocking part of the illuminator is that less UV radiation or light is directed to the UV inks and the UV inks are pre-cured. The unshaded or unblocked portion of the illuminator fully cures the UV inks. In another example, a lens or glass plate is attached to a bottom of the illuminator as the inks are pre-cured and/or cured by the illuminator. The lens allows the UV radiation to pass through the lens while reflecting heat or infrared radiation. Medias that are heat or pressure sensitive are thus protected from excessive heat while permitting the ink to be pre-cured and/or cured.

In another example, the illuminator may include separate light sources. One of the light sources serves to pre-cure the inks while the other light source fully cures the inks. For example, low power mercury, xenon and suntan lamps can be used to pre-cure the inks, while high power lamps can be used to fully cure the inks.

The illuminator is configured to pre-cure the inks before they are fully cured. Pre-curing the UV inks has the advantage of permitting all of the layers to be fully cured in a single layer. As the various colors of ink are placed on the media, they are pre-cured such that they do not merge with other inks. The image quality is thus enhanced and the colors of the various inks are merged by a viewer's eyes. The inks thus lay next to each other and are fully cured as a thin film. This prevents one ink from obscuring or otherwise interfering with other inks.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to systems and methods for curing inks in a manner that reduces or prevents the ink drops from running on the media or merging one with another. More particularly, the present invention relates to systems and methods for pre-curing deposited inks to prevent blending of deposited inks and degradation of image quality. Embodiments of the present invention include pre-curing all of the colors of ink that are placed or deposited on a media before fully curing all of the colors of ink as a single layer or film.

The present invention will described with respect to use of ultraviolet (UV) curable inks. UV curable inks have distinct advantages over other types of inks, such as solvent inks. UV curable inks do not contain, for example, volatile organic compounds. Further, UV curable inks do not dry in the nozzles of the print heads, which enables UV curable ink systems to be cleaned more easily. In addition, curing or drying UV inks consumes less energy than other types or inks.

Another significant advantage of UV inks is that they can be hardened or cured through exposure to UV radiation. As described above, a UV ink includes photo initiators that absorb UV radiation. The photo initiators transform the absorbed energy into chemical energy that causes a chemical reaction to harden or cure the ink.

As previously stated, existing printing systems that use UV curable inks cure each layer or color of ink independently, leading to poorer image quality because some colors of ink tend to obscure other colors of ink. Alternatively, some printing systems attempt to cure all deposited inks at the same time, however, because all the ink droplets are liquid they tend to merge with one another or run, thereby resulting in poor image quality.

Figure 1A:
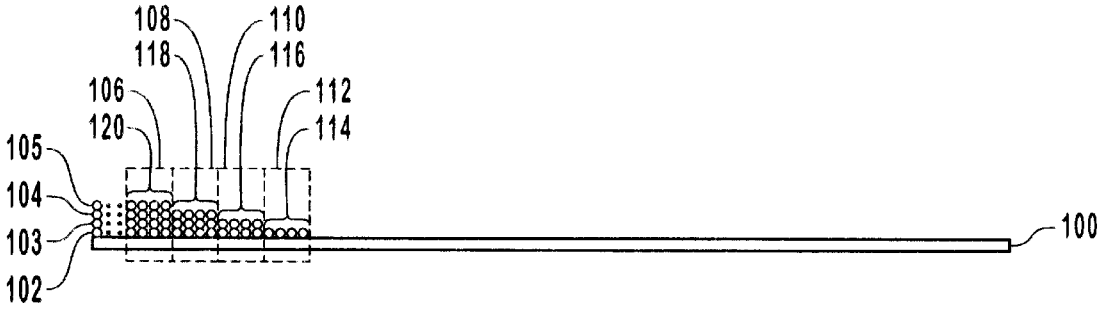
FIG. 1A (PRIOR ART)
FIG. 1A illustrates UV ink that is printed and hardened in layers on a media and illustrates that later layers of ink can obscure earlier layers of ink.

Another advantage of the present invention is that the inks will not be placed in layers as described with reference to FIG. 1. Rather, all colors of ink can be placed in a single layer because the pre-cured layers of ink are not hardened or fully cured. Thus, inks that are printed after inks that have already been printed and pre-cured are printed on the media next to the existing colors of pre-cured ink instead of on top of the existing colors of pre-cured ink. The pre-cured inks are changed such that they tend to flatten on the media and will not cure as tiny balls. The pre-cured layers of ink tend to form a single layer of ink that can be subsequently fully cured. The present invention relates to systems and methods for pre-curing and curing inks such that these and other problems described herein are reduced or eliminated.

Figure 1B:
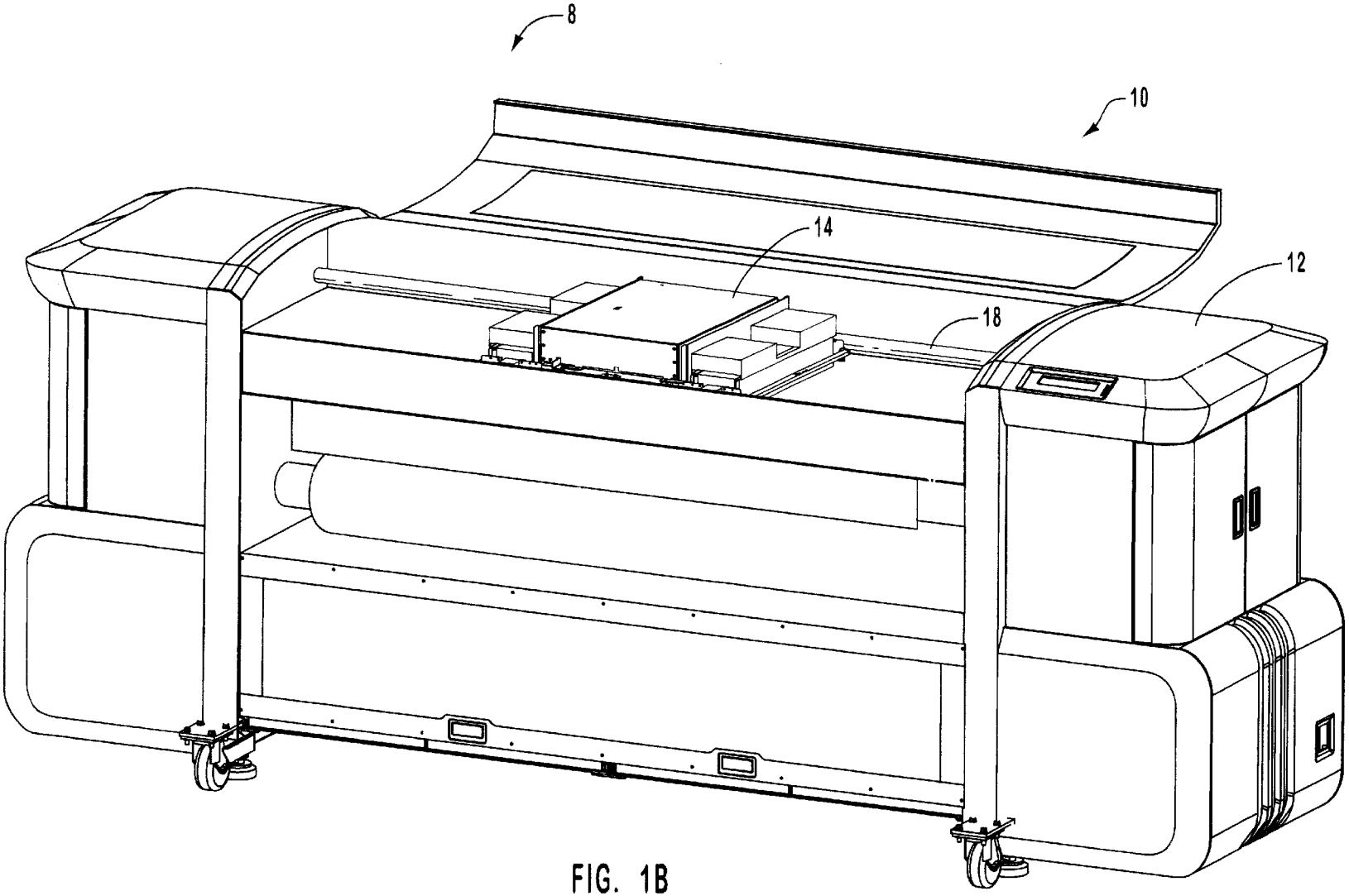
FIG. 1B illustrates a perspective view of an exemplary large format printer.

Referring now to FIG. 1B, depicted is an exemplary configuration of one printing system of the present invention. The printing system 8 includes a printing device 10 comprises a housing 12 that retains various components and control mechanisms of printing device 10, only some of which will be described herein for ease of explanation of the present invention, while others will be understood by those skilled in the art in light of the teaching contained herein. Disposed within housing 12 is a printer head carriage 14 that is movably mounted to a track 18 of printing device 10. The printer head carriage 14 moves back and forth along track 18 and allows delivery of ink from one or more print heads mounted to printer head carriage 14. Relative movement of printer head carriage along track 18 can occur through various driving mechanisms, such as but not limited to, hydraulic or pneumatic driver mechanisms, mechanical driver mechanisms, chain or belt and driven sprocket mechanisms, combinations thereof, or other types of driving mechanism that are capable of performing the function of moving the printer head carriage along a track.

Figure 2:
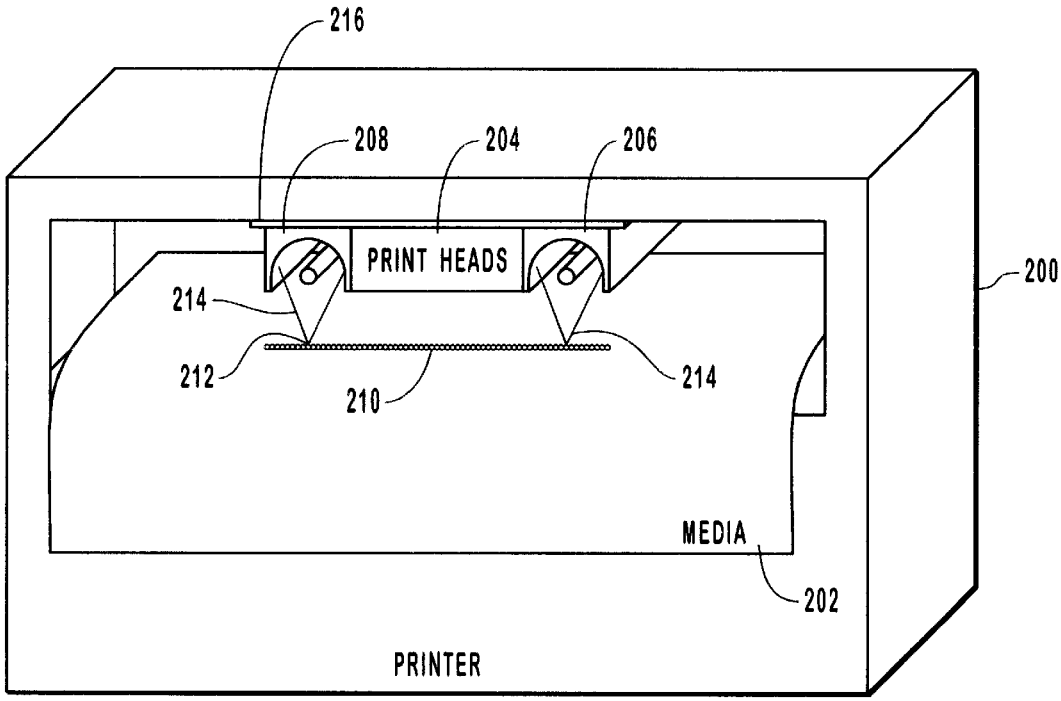
FIG. 2 illustrates an exemplary printing environment where illuminators are used to pre-cure and cure UV inks that are printed on a media.

FIG. 2 illustrates an exemplary environment in which the present invention may be practiced. FIG. 2 depicts a typical large format printer 200. The printer 200 prints ink from one or more print heads 204 onto a media 202, such as but not limited to, a cellulose media, a plastic media, combinations thereof, or other media that is capable of receiving ink delivered from the print heads during a printing process. The printer 200 often has at least one print head for each color of ink and may have more than one print head for each color of ink. Each of the print heads 204 places or prints ink on media 202. As previously stated, all colors of ink are usually printed at the same time. However, each color of ink is typically printed on a different portion of the media 202.

The printer 200 is typically configured to move print heads 204 back and forth across media 202. This is achieved by mounting print heads 204 within or on a carriage 216 that traverses back and forth along a track (not shown) under the control of appropriate driving mechanisms, such as but not limited to, hydraulic or pneumatic driver mechanisms, mechanical driver mechanisms, chain or belt and driven sprocket mechanisms, combinations thereof, or other types of driving mechanism that is capable of performing the function of moving the carriage along a track. As carriage 216 and print heads 204 move back and forth across media 202, UV inks are deposited on media 202 by print heads 204. Following each pass of print heads 204, printer 200 advances media 202 as necessary to allow print heads 204 to deposit the UV inks to form the desired image upon media 202.

In the example of FIG. 2, inks 210 placed on media 202 by print heads 204 are UV curable or UV inks. The UV inks 210 contain photo initiators that are activated by exposure to a certain level of ultraviolet radiation or light. The UV ink can be partially or completely cured by the UV radiation by varying the intensity of UV radiation irradiating the ink. When the inks are exposed to the requisite level of radiation or UV light, the photo initiators are activated and the inks are cured and form a hardened film on media 202. When the UV ink is irradiated with a different intensity of UV radiation, the ink is partially cured to prevent the ink from running or merging with other inks.

Following the deposit of all inks to create the desired image on media 202, the partially cured UV inks are completely cured by irradiating the ink with UV radiation of sufficient intensity to completely cure the ink. This is in contrast to other systems where each layer or color of ink is cured very quickly after it is placed or printed on media 202. As stated with reference to FIG. 1A, this tends to reduce the image quality because successive ink layers may obscure the lower ink layers degrade the completed image.

Accordingly, to allow pre-curing and curing of the deposited inks, this illustrative embodiment of printer 200 includes an illuminator 208 and an illuminator 206 mounted to carriage 216. As carriage 216 moves back and forth above media 202, each illuminator 208 and 206 focuses radiation on ink 210 and the ink irradiated by the illuminators is partially or completely cured. Illuminator 208 irradiates ink 212, while illuminator 206 irradiates ink 214. The rest of ink 210 is pre-cured or cured as illuminators 206 and 208 move across media 202. In this manner, illuminators 206 and 208 pre-cure and/or cure all of ink 210 placed on media 202 by print heads 204.

In another example, only a single illuminator is required to pre-cure and/or cure the inks. In addition, there is no requirement that illuminators 206 and 208 be mounted to carriage 216. For instance, illuminators 206 and 208 can be mounted to a support carrying print heads 204. However, mounting illuminators 206 and 208 to carriage 216 or adjacent to, abutting, contiguous with, or juxtaposed to the print heads 204 ensures that ink 210 is pre-cured or cured soon after it is placed on media 202. While the present invention is discussed in terms of an illuminator that moves over the media, the present invention extends to situations where the illuminator(s) are fixed and the media is moved relative to the illuminator(s) and/or the printer heads.

Figure 3:
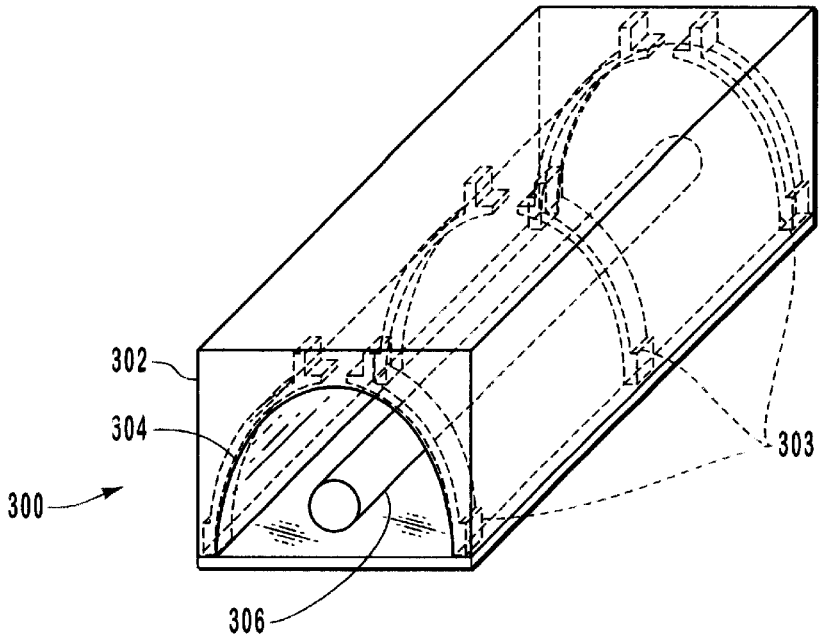
FIG. 3 is a perspective view of one embodiment of an illuminator with a single reflector.

FIG. 3 is a perspective view of an illuminator used to pre-cure or fully cure the inks shown in FIG. 2. The following discussion is applicable to illuminators 206 and 208 discussed with respect to FIG. 2. Similarly, the discussion of illuminators 206 and 208 is applicable to illuminator 300 described hereinafter. The illuminator 300 includes a housing 302 with a reflector 304 mounted therein. The reflector 304 is configured to direct radiation from a radiation source 306 onto inks that have been placed or deposited on a media. The reflector 304 can be mounted to the housing 302 using brackets 303 or other suitable connectors. It will be appreciated by one skilled in the art that various other methods of mounting reflector 304 to housing 302 can be used.

The reflector 304 may have a parabolic, elliptic, or other geometric shape in order to focus the radiation emitted by radiation source 306 toward the deposited inks. A parabolic reflector will reflect radiation in parallel while an elliptical reflector delivers maximum intensity. Although discussion is made here of use of a parabolic shaped or elliptic shaped reflector, one skilled in the art can appreciate that various other configurations of reflector 304 can be used to direct radiation generated by radiation source 306 towards the inks deposited on media 202. For instance, reflector 304 can have any curvature and optionally cooperate with one or more mirrors, lenses, prisms, or other optical components that direct the radiation toward media 202 (FIG. 2).

As illustrated, reflector 304 can be formed as a single continuous piece or may include multiple parts that are separate within the housing 302. For example, in one possible embodiment, the reflector 304 may include two symmetrical parts that are mounted on opposite sides of radiation source 306 but are still capable of directing the radiation generated by radiation source 306 toward media 202. In another configuration, two or more parts can be used to reflect the radiation generated by radiation source 306, whether or not such part form a complete curved surface within housing 302.

With reference to FIG. 2, illuminator 208 directs electromagnetic radiation 214 onto ink 210 as illuminator 208 moves across media 202. The radiation activates the photo initiators of ink 210 to fully and/or partially cure ink 210. The illuminator 304 can be used to pre-cure or fully cure the inks. For example, the illuminator 304 can be used to pre-cure the inks by positioning the reflector 304 such that the radiation reflected to the inks is insufficient to fully cure the ink. Alternatively, the amount of radiation delivered by the radiation source 306 can vary such that the amount of electromagnetic radiation reflected to the inks by the reflector 304 is reduced. The inks can be fully cured, for example, by changing a position of the reflector 304 within the illuminator or by increasing the radiation emitted by the radiation source 306.

Figure 4:
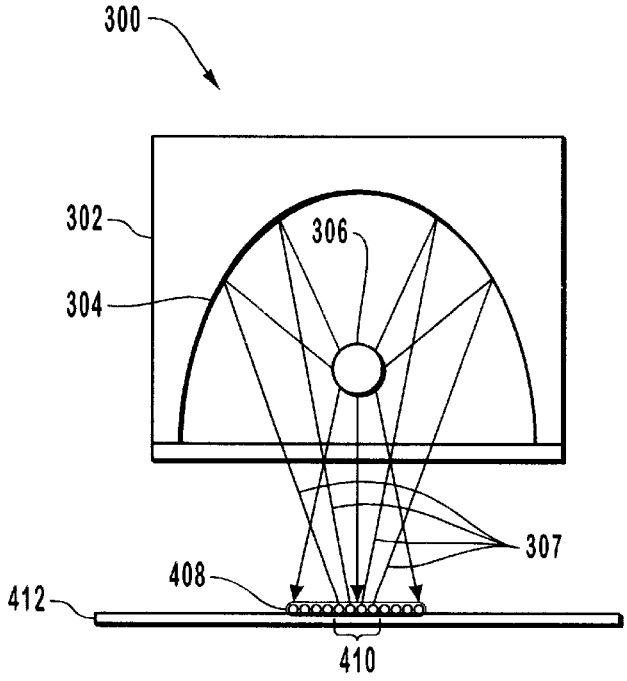
FIG. 4 is a cross sectional view of the illuminator shown in FIG. 3 and illustrates the UV radiation that is reflected towards the ink such that the ink is fully cured.

As illustrated in FIG. 4, reflector 304 focuses the UV radiation, identified by reference numeral 214 in FIG. 2 and reference numeral 307 in FIG. 4, on ink 410, which is only a portion of a wet ink 408. As illuminator 300 moves across wet ink 408, the focused radiation also moves along ink 408 such that all of ink 408 is cured. It is understood that, in one embodiment, the print heads and the illuminators move across the media at the same time. When the illuminator is pre-curing the inks, each color of ink is pre-cured soon after it is deposited on the media because the illuminator reflects radiation on the inks that have been placed by the print heads of the printing system. The inks are fully cured, in one embodiment, only after all colors have been printed on the media.

As previously stated, uncured or wet inks tend to run or merge, thus reducing the quality of the image. The present invention pre-cures the UV inks such that the UV inks are thickened or more viscous. The present invention chemically changes the ink such that it does not merge or run, but can still be fully cured after other colors of ink are deposited on the media. The more viscous UV ink droplets are less likely to run on the media or merge with other ink droplets. Thus, another color of wet ink can be placed on the media and pre-cured and the tendency of the ink droplets to merge together, run on the media, or form unintended colors is reduced. The printed UV inks thus retain their placement on the media and the various colors of ink form a single layer ink. When all colors of ink have been placed, the inks are fully cured. Because the different colors of ink are not cured independently, one color of ink will not obscure another color of ink and the printed image is improved.

Figure 5:
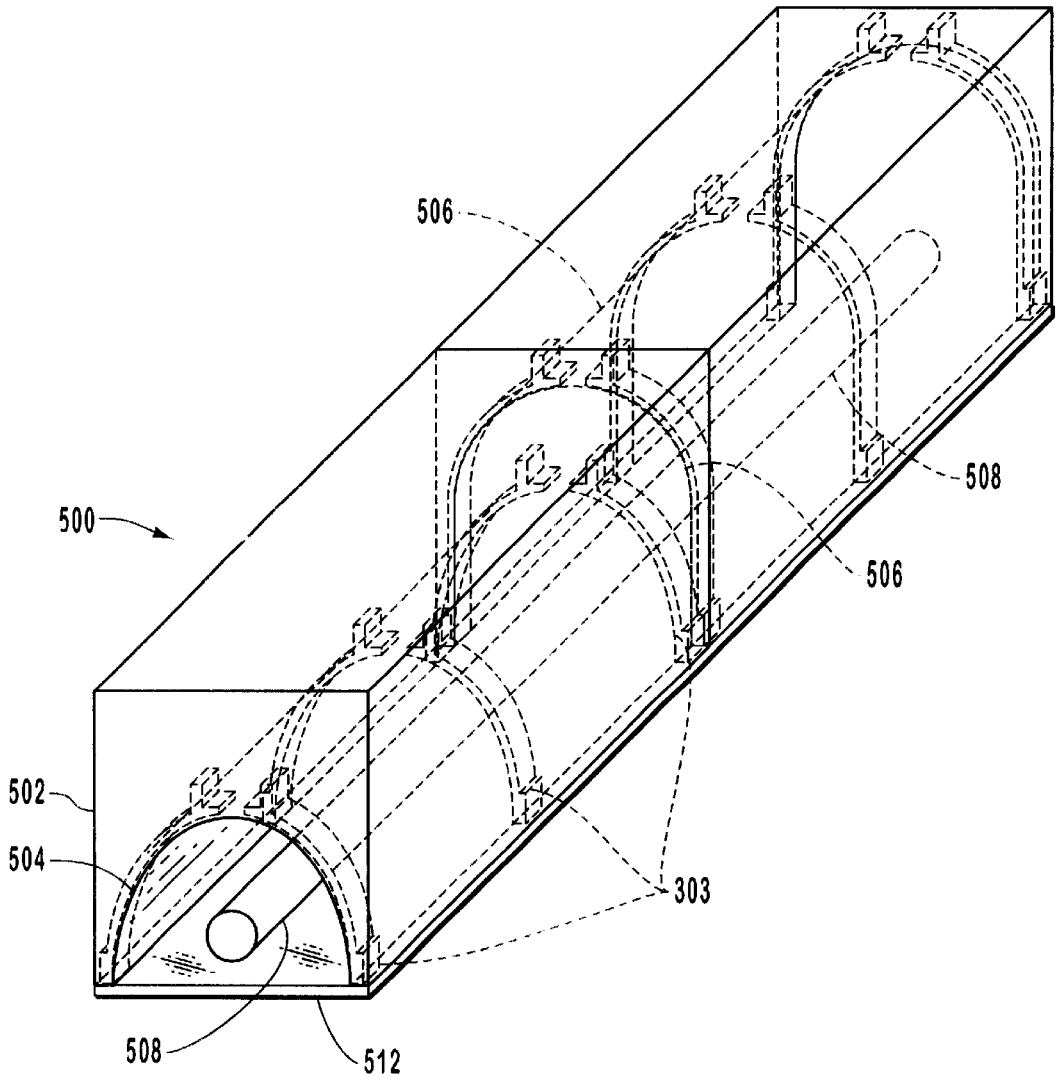
FIG. 5 is a perspective view of one possible embodiment of an illuminator that includes a pre-cure reflector, a cure reflector, and a lens that reduces the infrared radiation directed to a media.

FIG. 5 illustrates an exemplary illuminator 500 that is used to pre-cure and cure UV inks. The illuminator 500 includes a housing 502 with a cure reflector 504 and a pre-cure reflector 506 mounted or positioned inside housing 502. In this example, pre-cure reflector 506 is positioned more deeply within housing 502 than cure reflector 504 so that, in one configuration, radiation source 508 is distant from a longitudinal axis of the curved portion of pre-cure reflector 506. Because pre-cure reflector 506 is further away from radiation source 508, pre-cure reflector 506 does not focus the radiation from radiation source 506 with the same intensity as cure reflector 504. The net result of positioning reflector 506 in this manner is that the radiation received by the inks is diminished.

The pre-cure reflector 506 is positioned within illuminator 506 such that the UV inks are thickened or chemically altered without being fully cured. The reflector 506 is thus positioned such that the a viscosity of the UV ink is changed without fully curing the UV ink and without preventing the ink from being fully cured by reflector 504. By changing the viscosity of the UV ink, problems associated with an ink droplet being attracted to another ink droplet are reduced or eliminated. The ink droplets are more likely to remain in place on the media where they were originally placed without running or moving. The altered viscosity of the inks permits the inks to flatten on the media without completely blending or mixing with other colors of ink.

The advantage of pre-curing the ink is that the inks are not printed on top of each other or in different layers where one color of ink tends to obscure another color of ink. Because the WV inks are still liquid in nature, they tend to form a single flat layer. In addition, the inks do not merge to form colors that were not intended. After all inks have been placed and pre-cured, reflector 504 is able to focus radiation onto the cumulative layer of ink such that the ink is cured in a single layer or film on the media. The image quality is thereby improved because the colors are not obscured and they remain on the media where they were originally placed by the print heads.

FIG. 5 further illustrates an embodiment of an illuminator that includes an optional lens 512 that is connected to a bottom of the illuminator 500. Lens 512 is positioned such that the UV radiation generated by the radiation source is transmitted through lens 512 to pre-cure and/or cure the inks. However, lens 512 does not transmit infrared radiation or heat. The heat is reflected by lens 512. This is useful, for example, for medias that are sensitive to heat. Lens 512 thus prevents these types of media from peeling, cracking, and the like. Lens 512 is formed from, quartz glass, or other material that transmits UV radiation and reflects heat or infrared radiation. Optionally, a cooling element, such as fans are mounted to the illuminator to sink the heat that is reflected by lens 512.

Figure 6:
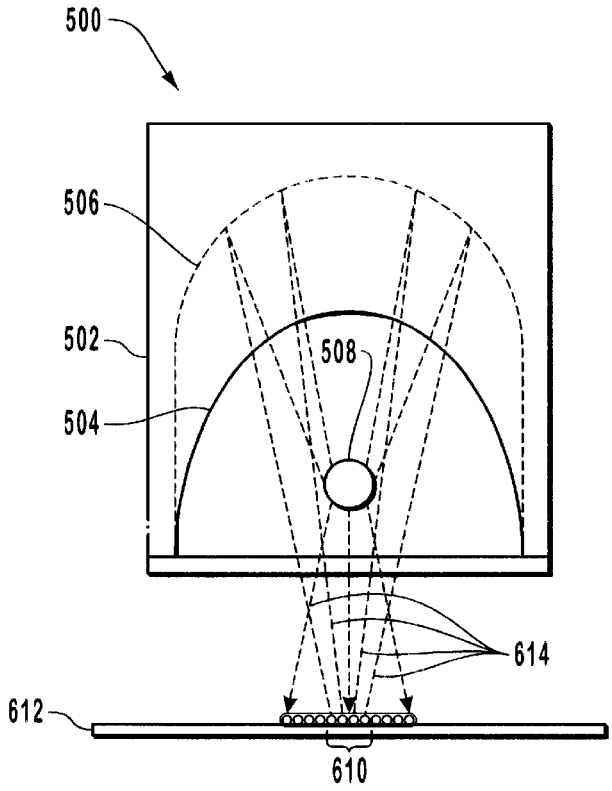
FIG. 6 is a cross sectional view of the illuminator shown in FIG. 5 and illustrates that the pre-cure reflector directs less radiation to the UV inks such that the UV inks are pre-cured.

FIG. 6 is a side view of illuminator 500 illustrated in FIG. 5. In this example, pre-cure reflector 506 is positioned such that the radiation directed to the ink 610 by pre-cure reflector 506 is less intense and is unable to fully activate the photo initiators. The dashed rays 614, which represent the UV radiation reflected by pre-cure reflector 506, have less intensity than the UV radiation reflected by cure reflector 504. The reflector 504, however, is positioned to direct or focus the necessary radiation on ink 610 to fully cure ink 610. When illuminator 500 is mounted in a printer, for example, reflector 504 does not focus UV radiation onto the inks until all colors of ink have been placed on the media for a particular portion of the media. Alternatively, illuminator 504 can be altered such that reflector 504 directs UV radiation onto less than all of the inks being used.

One skilled in the art can identify various other configurations of illuminator 500. In one configuration, pre-curing reflector 506 and/or curing reflector 508 can be moved, with respect to the radiation source and/or the media, to vary the intensity of radiation incident upon the inks deposited upon the media. Positioning of reflectors 506, 508 can be achieved manually or automatically through use of a driving mechanism that moves reflectors 506, 508 to position the radiation source at different positions relative to a longitudinal axis of each reflector 506, 508. For instance, the driving mechanism can include by not limited to, mechanical mechanisms, electrical mechanisms, pneumatic mechanisms, combinations thereof, or other mechanisms that are capable of incrementally moving reflector 506, 508 between different positions.

In another configuration, reflector 506 is used to both cure and pre-cure the deposited ink. In such a configuration, housing 502 includes a movable barrier member that partially or completely blocks radiation from becoming incident upon reflector 506. Alternatively, the barrier member completely blocks reflector 506, while partially absorbing the radiation incident upon reflector 506. In this manner, the barrier member limits the intensity of radiation directed to the wet ink deposited upon the media. In still another configuration, reflector 506 includes a barrier that limits the particular wavelength of UV radiation or other electromagnetic radiation that is directed to the ink to thereby pre-cure or cure the ink. In will be appreciated by one skilled in the art that various configurations may be utilized to vary the radiation from the reflector 506.

Figure 7:
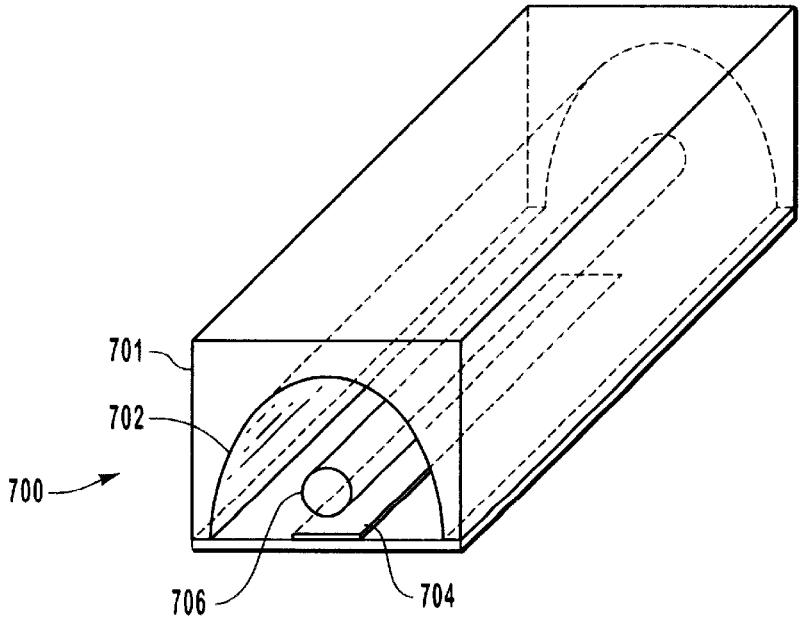
FIG. 7 is a perspective view of another possible embodiment of an illuminator with a single reflector where the radiation directed to the UV inks is blocked or shaded.

FIG. 7 illustrates another example of an illuminator according to another aspect of one embodiment of the present invention. In this example, a single reflector 702 is mounted in a housing 701. Some of the radiation emitted by a radiation source 706, however, is blocked or partially blocked by a filter 704. The filter 704 lessens the intensity of radiation or UV light that is directed to the ink such that the viscosity of the ink is changed without fully curing the ink. The unfiltered or unblocked portion of reflector 702 is used to fully cure the inks after all inks have been placed on the media and pre-cured. The filter 704 can block all radiation that is incident thereupon or alternatively block specific wavelengths of the radiation generated by source 706.

Figure 8:
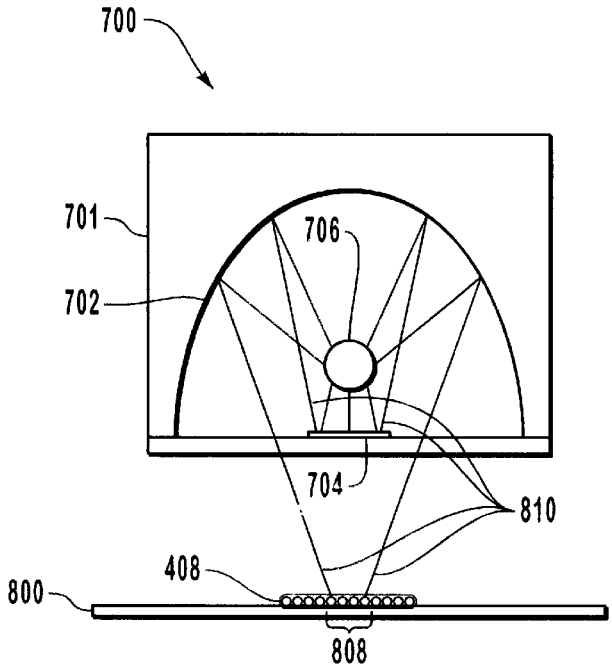
FIG. 8 is a cross sectional view of the illuminator shown in FIG. 7 and illustrates how some of the radiation is blocked or shaded from the UV inks.

The effect of filter 704 is more fully illustrated in FIG. 8. The radiation 810 emitted by source 706 is reflected by reflector 702 towards an ink 808 on a media 800. The filter 704 blocks some of radiation 810 emitted by source 706 such that inks 808 are pre-cured in preparation to being fully cured by the portion of the illuminator that is not blocked or shaded.

The pre-cure reflector, the reflector that is blocked by the filter, and the reflector that is focused by a lens are examples of pre-curing means for pre-curing UV inks. The cure reflector is an example of curing means for fully curing UV inks.

In another embodiment, the illuminator may include a combination of low and high power lamps to pre-cure and fully cure the inks. Exemplary low and high power lamps include, but are not limited to, mercury lamps, xenon lamps, and suntan lamps. Thus, the low power lamp is another example of a pre-curing means and the high power lamp is an example of a curing means. In addition, the low and high power lamps can be combined with the other illuminator embodiments described herein.

With reference to FIG. 5, for example, a high power lamp can be positioned within the illuminator 500 such that radiation emitted by the high power lamp is reflected by the cure reflector 504. At the same time, a low power lamp is positioned within the illuminator such that the radiation emitted by the low power lamp is reflected by the pre-cure reflector 506.

Figure 9:
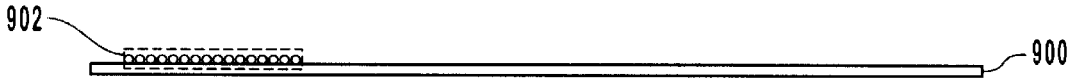
FIG. 9 illustrates that the pre-cured inks form a single layer of ink that can be fully cured.

FIG. 9 illustrates an example of ink cured using one or more of the illuminator(s) described herein. In this example, an ink 902 is deposited upon a media 900 by the print heads as known in the art. Thus, the different colors are placed or deposited on a particular portion of media 900 at different times. Because the inks were pre-cured, FIG. 9 illustrates that a single layer of ink is formed on media 900 instead of the various layers of ink illustrated in FIG. 1A. After each ink has been placed and pre-cured on the media, the resulting layer of pre-cured inks is fully cured. The inks can be pre-cured by mounting the illuminator next to the print head such that the portion of the illuminator that houses the pre-cure reflector pre-cures the various inks as they are placed or deposited. The cure-reflector of the illuminator is configured to direct radiation on the inks only after all of the inks have been deposited and pre-cured. In this manner, the inks retain their liquid nature without running on the media or merging with other inks and some inks are not obscured because the inks form a single layer on the media.

Figure 10:
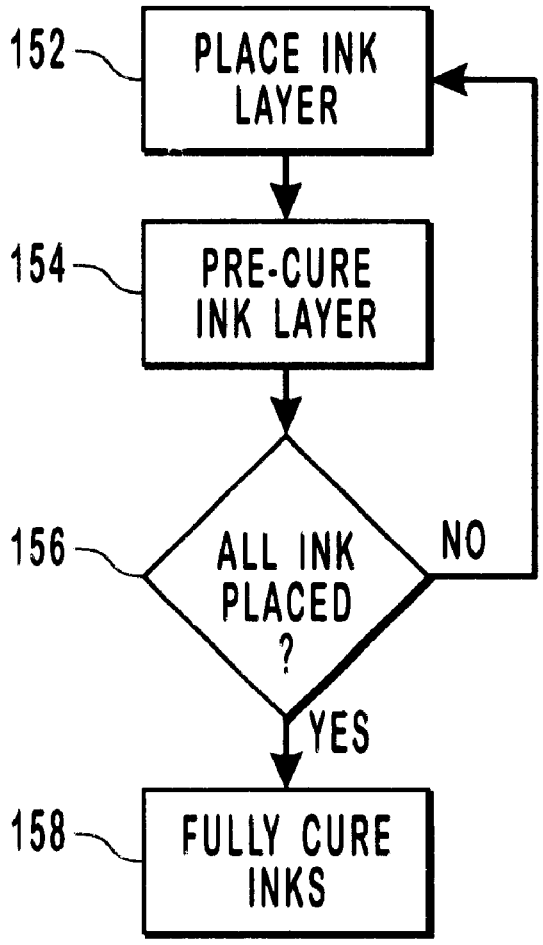
FIG. 10 is a flow diagram that illustrates an exemplary method for printing UV inks such that the inks are pre-cured before the UV inks are fully cured.

The present invention also relates to a method for depositing ink or to a method for curing ink as illustrated in FIG. 10. The print heads place an ink layer, as represented by block 152. The ink layer is then pre-cured, as represented by block 154 using an illuminator as described herein. Partially irradiating the ink layer or pre-curing the inks changes a viscosity of the ink layer so that the ink is prevented from running or merging with other ink drops deposed upon the media. In the event that all the UV ink colors or layers have been printed or placed, as represented by decision block 156 being in the affirmative, then all of the UV ink is cured at the same time instead of curing each ink independently, as represented by block 158. In the event that all of the UV inks have not been placed, as represented by decision block 158 being negative, another ink layer or color or ink is placed, as represented by block 152 and pre-cured, as represented by block 156 before the UV inks are fully cured, as represented by block 158.

While the present invention has been discussed in terms of UV inks, the present invention can be applied to other substances, such as glues and lacquers, that include photo initiators and that are cured by electromagnetic radiation.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. In a printing system using at least one ink curable with radiation, an illuminator for directing radiation to cure the at least one ink, the illuminator comprising:

a housing;

a radiation source located within the housing;

a pre-cure reflector positioned within the housing, the position of the pre-cure reflector within the housing being configured to direct radiation from the radiation source to the at least one ink to change a viscosity of the at least one ink without fully curing the at least one ink; and a cure reflector mounted within the housing, the mounting of the cure reflector within the housing being configured to direct radiation from the radiation source to the at least one ink to fully cure the at least one ink.

2. An illuminator as defined in claim 1, wherein the housing is configured to be connected with print heads of the printing system.

3. An illuminator as defined in claim 1, wherein the pre-cure reflector comprises one or more of of:

a parabolic mirror;

an elliptic mirror;

a mirror;

a lens; and a prism.

4. An illuminator as defined in claim 1, wherein the pre-cure reflector is positioned within the housing at a position that is further away from the radiation source than the cure reflector such that the pre-cure reflector directs less intense radiation to the inks, wherein the at least one ink is pre-cured by the pre-cure reflector.

5. An illuminator as defined in claim 1, further comprising a filter that blocks a portion of the radiation reflected by the pre-cure reflector, wherein the filter is connected to a bottom of the housing.

6. An illuminator as defined in claim 1, further comprising a lens connected to a bottom of the housing, wherein the lens transmits radiation reflected by the pre-cure reflector and the cure reflector such that radiation reflected by the pre-cure reflector pre-cures the inks and radiation reflected by the cure reflector fully cures the inks, wherein the lens reflects heat such that the media is not altered by the heat.

7. An illuminator as defined in claim 1, wherein the radiation source comprises a low power lamp and a high power lamp, wherein the pre-cure reflector directs radiation from the low power lamp to the at least one ink and wherein the cure reflector directs radiation from the high power lamp to the at least one ink.

8. In a printing system using inks that are cured using ultraviolet radiation, an illuminator for curing the inks, the illuminator comprising:

an ultraviolet radiation source located in a housing, wherein the ultraviolet radiation source generates the ultraviolet radiation used to cure the inks;

pre-curing means, mounted within the housing, for directing the ultraviolet radiation to the inks to pre-cure the inks; and curing means, mounted within the housing next to the pre-curing means, for directing the ultraviolet radiation to the inks to fully cures the inks that have been pre-cured.

9. An illuminator as defined in claim 8, wherein the pre-curing means comprises a pre-cure reflector that is positioned within the housing such that the radiation reflected by the pre-cure reflector is less intense than the radiation reflected by the curing means.

10. An illuminator as defined in claim 8, wherein the pre-curing means comprises:

a pre-cure reflector mounted with the housing, wherein the pre-cure reflector reflects radiation from the radiation source to the inks; and a filter that blocks a portion of the radiation reflected by the pre-cure reflector such that a viscosity of the inks is changed without fully curing the inks.

11. An illuminator as defined in claim 8, wherein the pre-curing means comprises a pre-cure lamp and wherein the curing means comprises a curing lamp.

12. An illuminator as defined in claim 11, wherein the pre-cure lamp emits less power than the curing lamp.

13. An illuminator as defined in claim 8, wherein pre-curing means comprises:

a pre-cure reflector mounted with the housing, wherein the pre-cure reflector reflects radiation from the radiation source to the inks; and a lens that transmits radiation from the radiation source on the inks such that a viscosity of the inks is changed without fully curing the inks, wherein the lens reflects heat generated by the radiation source such that a media is not altered by the heat.

14. An illuminator as defined in claim 8, wherein the curing means comprises a cure reflector mounted within the housing, wherein the cure-reflector reflects radiation to the inks such that the inks are fully cured.

15. An illuminator as defined in claim 8, wherein the housing is configured to be connected with print heads of the printing system.

16. An illuminator as defined in claim 8, wherein the pre-curing means comprises at least one of:

a parabolic mirror;

a parabolic mirror;

an elliptic mirror;

a mirror;

a lens; and a prism.

17. An illuminator as defined in claim 8, wherein the pre-curing means is positioned within the housing at a position that is further away from the radiation source than the curing means such that the pre-curing means directs less intense radiation to the inks.

18. In a printing systems that uses UV inks, a method for printing the inks on a media that reduces the tendency of wet UV inks to run or merge and that prevents the UV inks from being printed in more than one fully cured layer, the method comprising:

for each ink, pre-curing the wet ink that has been printed on the media such that a viscosity of the inks is changed without fully curing the ink, wherein each ink is pre-cured by an illuminator that reflects radiation to each ink using a pre-cure reflector, wherein all the inks form a single layer of ink on the media; and after all the inks have been pre-cured, curing the single layer of ink with the illuminator that reflects radiation to the single layer of ink using a cure reflector, wherein the radiation reflected by the cure reflector is more intense than the radiation reflected by the pre-cure reflector.

19. A method as defined in claim 18, further comprising printing each ink on the media.

20. A method as defined in claim 18, wherein pre-curing the wet ink that has been printed on the media further comprises pre-curing each ink immediately after each ink is placed on the media.

21. In a system using a substance that are cured using electromagnetic radiation, an illuminator for curing the substance, the illuminator comprising:

an electromagnetic radiation source located in a housing, wherein the electromagnetic radiation source generates the electromagnetic radiation used to cure the sub stance; and reflector means for pre-curing a portion of the substance and for curing the portion of the substance that has already been pre-cured.

22. An illuminator as defined in claim 21, wherein the reflector means further comprises:

pre-curing means for directing the electromagnetic radiation to a portion of the substance to pre-cure the portion of the substance; and curing means for directing the electromagnetic radiation to the portion of the substance to fully cures the portion of the substance after the portion of the substance has been pre-cured.

23. An illuminator as defined in claim 21, wherein the reflector means further comprises:

a pre-cure reflector positioned within the housing, the position of the pre-cure reflector within the housing being configured to direct radiation from the radiation source to the at least one ink to change a viscosity of the at least one ink without fully curing the at least one ink; and a cure reflector mounted within the housing, the mounting of the cure reflector within the housing being configured to direct radiation from the radiation source to the at least one ink to filly cure the at least one ink.

* * * * *

UNITED STATES PATENT AND TRADEMARK OFFICE

CERTIFICATE OF CORRECTION

PATENT NO. : 6,739,716 B2
APPLICATION NO. : 10/166284
DATED : May 25, 2004
INVENTOR(S) : David B. Richards It is certified that error appears in the above-identified patent and that said Letters Patent is hereby corrected as shown below:

Column 1,
Line 58, after “all other ink” change “layer” to -- layers --.

Column 4,
Line 5, after “invention will” insert -- be --.
Line 12, after “than other types” change “or” to -- of --.
Line 25, change “same time, however,” to -- same time; however, --.
Line 26, after “are liquid” insert -- , --.
Line 45, before “a housing 12” change “comprises” to -- comprising --.
Line 55, after “printer head carriage” insert -- 14 --.
Line 58, after “chain or belt” remove “and”.

Column 5,
Line 1, after “other media that” change “is” to -- are --.
Line 15, after “chain or belt” remove “and”.
Line 17, change “mechanism that is” to -- mechanisms that are --.
Line 45, after “ink layers” insert -- and thereby --.

Column 6,
Line 41, after “whether or not such” change “part” to -- parts --.

Column 7,
Line 40, before “viscosity of the UV ink” remove “a”.
Line 53, change “WV inks” to -- UV inks --.

Column 8,
Line 35, after “can include” change “by” to -- but is --.

Column 9,
Line 46, before “are not obscured” change “some inks” to -- and previous ink layers --.
Line 53, after “the inks changes” change “a” to -- the --.

UNITED STATES PATENT AND TRADEMARK OFFICE

CERTIFICATE OF CORRECTION

PATENT NO. : 6,739,716 B2
APPLICATION NO. : 10/166284
DATED : May 25, 2004
INVENTOR(S) : David B. Richards It is certified that error appears in the above-identified patent and that said Letters Patent is hereby corrected as shown below:

Column 12,
Line 55, after "at least one ink to" change "filly" to -- fully --.

Signed and Sealed this

Eleventh Day of July, 2006

JON W. DUDAS
*Director of the United States Patent and Trademark Office*